US009011813B2

(12) United States Patent
Guyomarc'h et al.

(10) Patent No.: US 9,011,813 B2
(45) Date of Patent: Apr. 21, 2015

(54) METHOD AND SYSTEM FOR PRODUCING INTEGRATED HYDROGEN FROM ORGANIC MATTER

(75) Inventors: Raymond Guyomarc'h, Saint Theodorit (FR); Sébastien Roux, Choisy Au Bac (FR)

(73) Assignee: Aymar Vernes, Paris (FR)

( * ) Notice: Subject to any disclaimer, the term of this patent is extended or adjusted under 35 U.S.C. 154(b) by 754 days.

(21) Appl. No.: 12/864,105

(22) PCT Filed: Jan. 21, 2009

(86) PCT No.: PCT/FR2009/050080

§ 371 (c)(1),
(2), (4) Date: Jul. 22, 2010

(87) PCT Pub. No.: WO2009/098418

PCT Pub. Date: Aug. 13, 2009

(65) Prior Publication Data

US 2010/0297001 A1 Nov. 25, 2010

(30) Foreign Application Priority Data

Jan. 22, 2008 (FR) ..... 08 50385

(51) Int. Cl.

| | |
|---|---|
| ***B01J 7/00*** | (2006.01) |
| ***C01B 3/22*** | (2006.01) |
| ***C10J 3/66*** | (2006.01) |
| ***C10J 3/30*** | (2006.01) |
| ***C10J 3/40*** | (2006.01) |

(52) U.S. Cl.

CPC .... *C10J 3/66* (2013.01); *C10J 3/30* (2013.01); *C10J 3/40* (2013.01); *C10J 2200/158* (2013.01); *C10J 2300/0973* (2013.01); *C10J 2300/0983* (2013.01); *C10J 2300/0986* (2013.01); *C10J 2300/1884* (2013.01)

(58) Field of Classification Search

USPC ..... 423/648.1; 252/373; 48/61, 197 R

See application file for complete search history.

(56) References Cited

U.S. PATENT DOCUMENTS

| | | | | |
|---|---|---|---|---|
| 3,977,844 | A | 8/1976 | Van Slyke | |
| 4,497,637 | A * | 2/1985 | Purdy et al. | 48/111 |
| 4,568,271 | A * | 2/1986 | Mallek | 588/320 |

(Continued)

FOREIGN PATENT DOCUMENTS

| | | | |
|---|---|---|---|
| DE | 4030644 | A1 | 3/1992 |
| EP | 0271477 | A1 | 6/1988 |
| WO | WO/2007/102032 | A2 | 9/2007 |

*Primary Examiner* — Wayne Langel

(74) *Attorney, Agent, or Firm* — Greer, Burns & Crain, Ltd.

(57) ABSTRACT

A method for production of hydrogen from organic matter, includes: pyrolysis of a feed of organic matter by passing a gaseous treatment stream essentially having carbon dioxide through the organic matter, the pyrolysis producing, on the one hand, a pyrolysis gas stream having the gaseous treatment stream, steam and volatile organic compounds originating from the organic matter, and on the other hand pyrolysis chars having carbon components; oxycombustion of at least a proportion of the volatile organic compounds present in the pyrolysis gas stream, by injection of oxygen, upstream of a layer of redox filtering matter comprising high-temperature carbon components; and after the oxycombustion, passing the oxidized pyrolysis gas stream through the redox layer, the passage producing a synthesis gas stream comprising hydrogen obtained by deoxidation of steam by the high-temperature carbon components.

9 Claims, 6 Drawing Sheets

(56) References Cited

U.S. PATENT DOCUMENTS

| | | | | |
|---|---|---|---|---|
| 4,865,625 | A * | 9/1989 | Mudge et al. | 48/197 R |
| 6,863,878 | B2 * | 3/2005 | Klepper | 423/650 |
| 7,335,320 | B2 * | 2/2008 | Kindig et al. | 252/373 |
| 8,021,577 | B2 * | 9/2011 | Johnson et al. | 252/373 |
| 8,202,332 | B2 * | 6/2012 | Agblevor | 48/197 R |
| 8,323,366 | B2 * | 12/2012 | Ljunggren | 48/197 R |
| 2002/0006372 | A1 * | 1/2002 | Sugimoto et al. | 423/267 |
| 2002/0048545 | A1 * | 4/2002 | Lewis | 423/418.2 |
| 2002/0095866 | A1 * | 7/2002 | Hassett | 48/199 FM |
| 2004/0060236 | A1 | 4/2004 | Yoshikawa et al. | |
| 2008/0104887 | A1 * | 5/2008 | Tsangaris et al. | 48/197 R |
| 2008/0171899 | A1 * | 7/2008 | Pulkrabek et al. | 585/240 |
| 2009/0077891 | A1 * | 3/2009 | Duca et al. | 48/197 FM |

* cited by examiner

METHOD AND SYSTEM FOR PRODUCING INTEGRATED HYDROGEN FROM ORGANIC MATTER

BACKGROUND

The present invention relates to an integrated method of production of hydrogen ($H_2$). It also relates to a system using the method according to the invention.

The field of the invention is the field of the production of synthesis gas from organic matter and more particularly the field of the production of $H_2$.

Methods and systems already exist for production of $H_2$ from gases from pyrolysis or gasification of biomass or from any wastes. These systems provide synthesis of $H_2$ by high-temperature treatment of biomass. Said treatment generally comprises a first phase of pyrolysis of the biomass followed by a phase of gasification of the biomass. These two operations are either carried out in a single stage or in two separate stages with movement of the biomass from the stage performing the pyrolysis to the stage performing the gasification. The synthesis gases obtained after gasification comprise $H_2$ and carbon monoxide (CO) in variable proportions that cannot be determined a priori, and mixed with other compounds.

These methods and systems have several drawbacks.

One drawback of these methods and systems arises from the fact that it is not possible to control the $H_2$/CO ratio. Moreover, it is not possible to determine this ratio a priori. Furthermore, in these systems the proportion of $H_2$ is in general lower than the proportion of CO.

Another drawback of these systems is the loss of usable carbon components obtained from the biomass.

Yet another drawback of these systems arises from the formation of polluting residues such as tars. Certain methods and systems envisage operations for removing these tars. However, these operations are complex and expensive.

Finally, some existing methods and systems require the use of biomass or wastes that have a low moisture content. And this has the drawback of prior treatment of the biomass to reduce the moisture content of the biomass.

SUMMARY

One aim of the invention is to propose a method and a system for production of $H_2$ from organic matter regardless of the moisture content of the organic matter.

Another aim of the invention is to propose a system for production of $H_2$ from plant biomass that is in the form of a single, integrated, complete unit that is less expensive than the existing systems.

Finally, another aim of the invention is to propose a method and system for production of $H_2$ from plant biomass that allows the proportion of $H_2$ produced to be controlled.

Thus, the invention proposes a method of production of hydrogen ($H_2$) from organic matter, said method comprising the following stages:

- pyrolysis of a feed of organic matter by passing a gaseous treatment stream through said organic matter. According to the invention the gaseous treatment stream essentially comprises $CO_2$ heat-transfer medium. Pyrolysis produces, on the one hand, a pyrolysis gas stream comprising the gaseous treatment stream, steam ($H_2O$) and volatile organic compounds (VOCs) originating from the organic matter, and on the other hand pyrolysis chars comprising carbon components;
- oxycombustion of said volatile organic compounds present in the pyrolysis gas stream, by injection of oxygen, upstream of a layer of redox filtering matter comprising high-temperature carbon components; and
- after said oxycombustion, passing said oxidized pyrolysis gas stream through said redox layer, said passage producing a synthesis gas stream comprising hydrogen ($H_2$) obtained by deoxidation of steam by the high-temperature carbon components.

The deoxidation of steam by the high-temperature carbon components of the redox layer takes place according to the following reactions:

$$C+H_2O \rightarrow CO+H_2$$

$$C+2H_2O \rightarrow CO_2+2H_2$$

The method according to the invention makes it possible to produce hydrogen from organic matter, regardless of the moisture content of the organic matter, it integrates the prior dehydration of the organic matter, with a view to utilization of the steam and the inherent energy, in the course of the pyrolysis stage. Thus, it is not necessary, in the method according to the invention, for the organic matter to undergo a previous treatment, for example drying, to reduce the moisture content of the organic matter.

Moreover, the method according to the invention makes it possible to treat the heavy compounds present in the pyrolysis gas. The latter are cracked during oxycombustion of the VOCs.

The redox layer can advantageously comprise oxides in a reduced form. These oxides achieve a deoxidation of a proportion of the steam ($H_2O$), said deoxidation producing hydrogen components ($H_2$). After deoxidation, the oxides are in an oxidized form. The deoxidation of steam by oxides in reduced form takes place according to the following reaction:

$$Me+H_2O \rightarrow MeO+H_2$$

After deoxidation of $H_2O$, the oxides are activated or oxidized.

Advantageously, at least a proportion of the oxides in an oxidized form, obtained as a result of deoxidation of steam according to the reaction described above in the redox layer is used for oxidation of the volatile organic compounds (VOCs) upstream of the redox layer. After oxidation of the VOCs, the oxides are in a reduced form again. At least a proportion of these oxides in reduced form is used again in the redox layer for a new operation of deoxidation of steam.

Thus, the method according to the invention comprises a loop for recycling the oxides, between the redox layer where these deactivated oxides are activated by deoxidation of steam, and a zone for oxidation of the VOCs where the activated oxides are deactivated as a result of oxidation of the VOCs.

Moreover, the oxycombustion is achieved by injection of oxygen, $O_2$, upstream of the redox layer.

Oxidation of the VOCs by the oxides is endothermic and is flameless, whereas the oxycombustion of the VOCs is exothermic and takes place with flames. Thus, to maintain the oxidation zone at a sufficient temperature for deoxidation of the VOCs, the method according to the invention requires a good balance between oxidation of the VOCs by oxides and the oxycombustion of the VOCs by injection of $O_2$. This balance is provided by feeding in the oxides in oxidized form depending on the organic matter. Thermal equilibrium is achieved by oxycombustion of a proportion of the VOCs. To increase the temperature of the oxidized pyrolysis gas stream that has to pass through the redox layer, it may be useful to carry out oxycombustion of a proportion of the carbon components in the lower portion of the redox layer, for example by injection of oxygen just below the redox layer.

In a particular embodiment, the following oxides can be used in the present invention: $Fe_2O_3$, NiO, CuO, CoO, CeO, ZnO, CaO, MgO, $TiO_2$, $Al_2O_3$. Of course, these oxides are given as non-limitative examples.

To obtain a reactivity that is both high and constant during the reactions of oxidation of the VOCs by the oxides, combinations of oxides can be used. Non-limitative examples of combinations of oxides are $Fe_2O_3$/CaO, NiO/$Al_2O_3$, CuO/$TiO_2$, CoO/MgO, CoO/CaO.

At the outlet of the redox layer, the synthesis gas stream may additionally comprise carbon monoxide (CO) and steam ($H_2O$). The method according to the invention can comprise, in this case, lowering the temperature of the synthesis gas stream downstream of the redox layer. This lowering of the temperature can be achieved by interposing at least one heat exchanger, which will also have the aim of absorbing the exothermic effect of the redox reaction, called water-shift, which is thus made possible between the carbon monoxide (CO) and the steam ($H_2O$), producing $H_2$ and $CO_2$ according to the equation:

$$CO+H_2O \rightarrow CO_2+H_2$$

The method according to the invention makes it possible, because of this stage of reduction of the steam by carbon monoxide compounds, to control and vary the proportion of $H_2$ produced in the synthesis gas stream.

After the water-shift reaction, also called CO-shift, the synthesis gas stream can comprise residual, unreduced steam, depending on the initial wet organic feed. To remove the residual steam, the method according to the invention can comprise separation of the steam from the other components present in the synthesis gas stream by condensation of the steam. This condensation can be achieved by lowering the temperature of the synthesis gas stream to the condensation temperature of the steam.

After separation of the residual steam, the synthesis gas stream comprises in principle hydrogen, carbon dioxide and the gaseous treatment stream.

The method according to the invention can then comprise a stage of separation of the hydrogen $H_2$ present in the synthesis gas stream. This separation can be achieved by techniques known to a person skilled in the art, for example a membrane system for molecular separation.

After separation of the dihydrogen, the residual synthesis gas stream essentially comprises $CO_2$. At least a proportion of this $CO_2$ can be reused as gaseous treatment stream for the pyrolysis of a new feed of organic matter after being heated. At least a proportion of the $CO_2$ obtained therefore becomes the heat carrier stream for the pyrolysis of a new feed of organic matter.

Advantageously, the lowering of the temperature of the synthesis gas stream downstream of the redox layer can comprise a transfer of heat energy from this synthesis gas stream to at least a proportion of the gaseous treatment stream, thus bringing said gaseous treatment stream up to a temperature for pyrolysis of a feed of organic matter. Thus, the method according to the invention can comprise a recycling loop allowing continuous reuse of the gaseous treatment stream serving for pyrolysis of the organic matter. Thus, the reused $CO_2$ is recycled continuously and is not discharged into the atmosphere.

Moreover, the lowering of the temperature of the synthesis gas stream downstream of the redox layer can additionally comprise a transfer of heat energy to circulating liquid water, thus achieving a change of state of said liquid water to obtain superheated steam.

The method according to the invention can further comprise a stage of addition of steam to the oxidized pyrolysis gas stream. This steam can be that obtained above. In fact, when the organic matter to be pyrolyzed is not wet enough to obtain an adequate quantity of steam in the pyrolysis gas stream to obtain a desired quantity of hydrogen, the oxidized pyrolysis gas stream can be enriched with steam, either to make up for the low moisture content of the organic matter and increase the quantity of $H_2$ obtained, or to adjust the $H_2$/CO ratio. In fact, the quantity of residual steam in the synthesis gas stream must be large enough to carry out the water-shift reaction described above.

According to an advantageous feature of the method according to the invention, at least a proportion of the pyrolysis chars generated in the pyrolysis stage can be used to make up at least a proportion of the layer of redox filtering matter.

This pyrolysis stage can take place progressively in the form of substages, said substages carrying out progressive gasification of the organic matter.

In a particular version of the method according to the invention, the pyrolysis stage can be:

- preceded by a previous stage of dehydration of the organic matter, and/or
- followed by a stage of carbonization of the biomass after the pyrolysis stage, said carbonization stage completing the gasification of the organic matter.

According to another aspect of the invention, a system is proposed for production of hydrogen from organic matter, said system comprising a single enclosure comprising:

- a first reactor for pyrolysis of a feed of organic matter by passing a gaseous treatment stream through said organic matter comprising essentially $CO_2$ heat-transfer medium, said pyrolysis supplying, on the one hand, a pyrolysis gas stream comprising said gaseous treatment stream, steam ($H_2O$) and volatile organic compounds (VOCs), and on the other hand pyrolysis chars comprising carbon components, and
- a second reactor comprising:
  - a zone for oxidation of said volatile organic compounds present in said pyrolysis gas stream by oxygen components, and
  - a grate supporting a layer of redox filtering matter comprising high-temperature carbon components, located downstream of the oxidation zone, provided to be passed through by said oxidized pyrolysis gas stream received from the oxidation zone, said stream is then composed of the treatment stream, molecules produced by oxidation of the VOCs ($CO_2$, $H_2O$, etc.) and initial and/or injected steam, to provide a synthesis gas stream comprising hydrogen obtained by deoxidation, by said carbon components, of at least a proportion of the steam present in said oxidized pyrolysis gas stream.

The system according to the invention makes it possible to produce, in a single integrated enclosure which is in the form of a monobloc assembly, hydrogen from wet organic matter, for example wet biomass, in contrast to the existing installations in which the biomass and/or the organic matter is first heat-treated in a first enclosure to reduce its moisture content, and then transported to a second enclosure for generating hydrogen.

The first reactor comprises at least one grate on which the organic matter to be pyrolyzed is placed. In a particular version of the system according to the invention, the first reactor can comprise a plurality of grates, arranged one under another, each of said grates being suitable for:

injecting the gaseous treatment stream into the organic matter arranged on said grate, allowing the upward passage of the gaseous treatment stream from the lower grates, laden with VOCs and steam originating from the feed of organic matter contained by said grates, and receiving the organic matter from a higher grate and transferring the organic matter to a lower grate.

In fact, in this particular version, the gaseous treatment stream is injected directly into the core of the organic matter on each grate. Each of the grates of the first reactor comprises one or more orifices for distributing the gaseous treatment stream to the organic matter located on said grate. The organic matter arranged on a grate is moreover passed through by the gaseous treatment stream from the lower grates. Furthermore, each of the grates can be mechanized.

Moreover, the first and the second reactor are separated by a double wall forming a communication connecting the top part of the first reactor to the bottom part of the second reactor, said communication allowing:

passage of the pyrolysis gas stream from the top part of said first reactor to the bottom part of said second reactor, and heat exchange between said second reactor and the pyrolysis gas stream.

Advantageously, the layer of redox matter can further comprise oxides in reduced form that take part in the deoxidation of steam passing through this layer, the deoxidation of steam by the oxides producing dihydrogen ($H_2$) and oxides in an oxidized form.

The zone for oxidation of the volatile organic compounds can further comprise one or more oxygen injectors arranged for injecting oxygen, which is required for oxycombustion of at least a proportion of the volatile organic compounds into said oxidation zone.

The zone for oxidation of the volatile organic compounds can further comprise one or more oxygen injectors (with an ignition device) arranged for injecting oxygen, which is necessary for oxycombustion of at least a proportion of the volatile organic compounds, upstream of said oxidation zone.

Moreover, the grate supporting the layer of redox matter is arranged to allow the flow of the oxides in oxidized form to the zone for oxidation of the volatile organic compounds, at least a proportion of the volatile organic compounds being oxidized by said oxides in oxidized form. Thus, the oxides that are at high temperature in the redox layer are transferred to the zone for oxidation of the VOCs naturally, and without manipulation.

The zone for oxidation of the volatile organic compounds (VOCs) can further comprise one or more grates, arranged one under another, and provided for slowing the flow of the oxides in oxidized form so as to improve the oxidation of the volatile organic compounds (VOCs) by the oxides in oxidized form.

The system according to the invention can further comprise a transfer device, which transfers:

pyrolysis chars from the first reactor to the grate of the second reactor supporting the layer of redox matter, and oxides in reduced form from the bottom part of the second reactor to said grate, said pyrolysis chars and said oxides in reduced form being mixed homogeneously before or during transfer, before being arranged on said grate. Homogeneous mixing of oxides and pyrolysis chars before they are arranged on the grate supporting the redox layer provides a homogeneous layer of redox matter and makes it possible to bring the carbon components (pyrolysis chars) to the temperature suitable for their oxidation by the oxygen of the $H_2O$ molecule.

Downstream of the redox layer, the synthesis gas stream can comprise carbon monoxide (CO) and steam ($H_2O$). The system according to the invention further comprises at least one heat exchanger arranged for lowering and controlling the temperature of the synthesis gas stream. This lowering of the temperature allows a redox reaction, called water-shift, between the carbon monoxide (CO) and the steam ($H_2O$), producing $H_2$ and $CO_2$.

In a particularly advantageous version, the system according to the invention can comprise:

a first exchanger provided for heat exchange from the synthesis gas stream to the gaseous treatment stream, and a second exchanger provided for heat exchange from the synthesis gas stream to liquid water, producing steam.

The steam obtained can be used for enriching the pyrolysis gas stream with steam in the case where the organic matter pyrolyzed in the first reactor has a moisture content that is too low.

The system according to the invention further comprises means for separating hydrogen from the synthesis gas stream.

The various openings to the outside of the system according to the invention are protected against any entry of external air by air locks maintained under $CO_2$.

Other advantages and characteristics will become apparent on examining the detailed description of one embodiment, which is in no way limitative, and the appended drawings in which:

DETAILED DESCRIPTION

Figure 1:
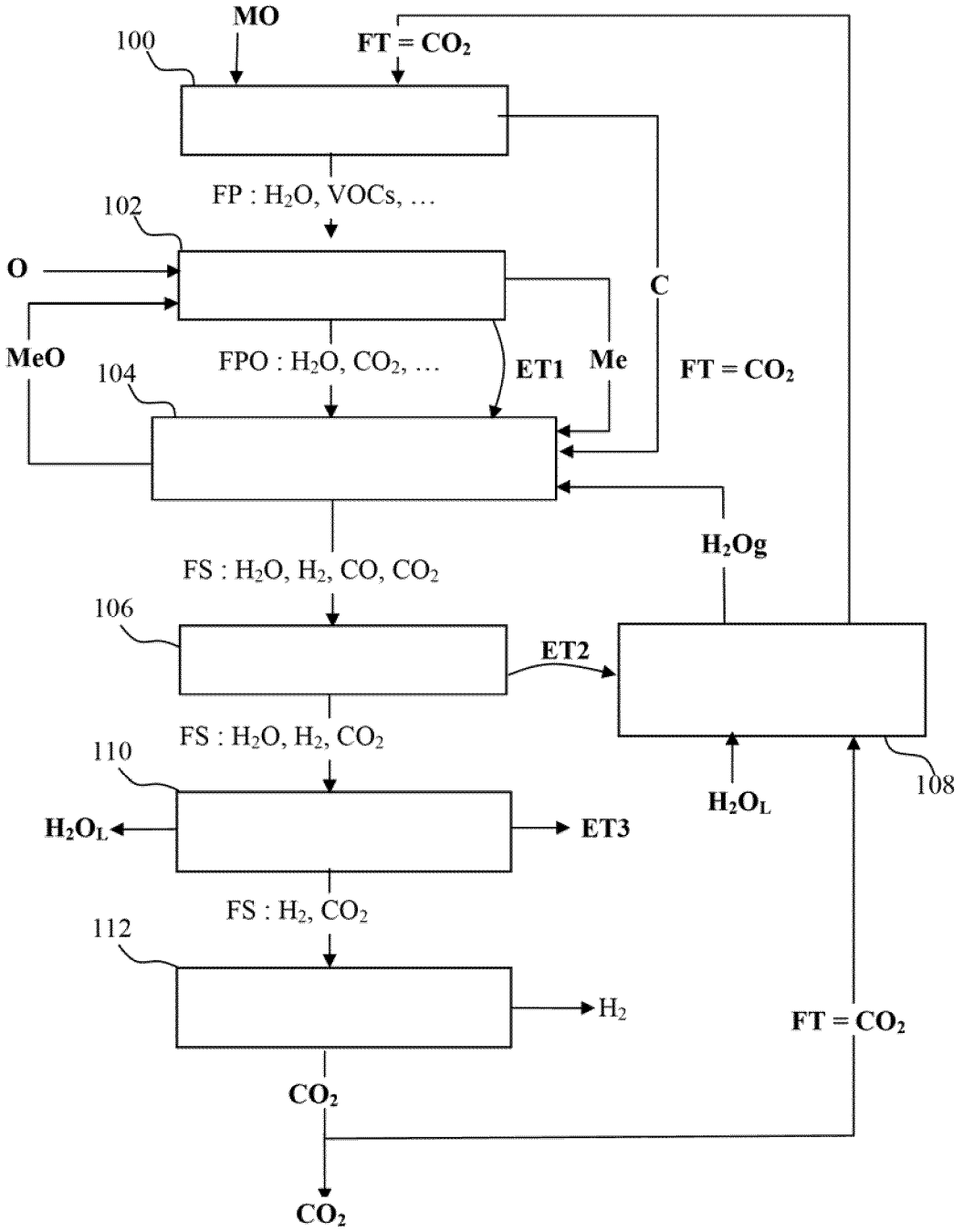
FIG. 1 is a schematic representation of a method according to the invention.

FIG. 1 is a representation of an example of different stages of a method according to the invention.

Organic matter MO, of varying moisture content, is fed into a first reactor together with a gaseous treatment stream FT which essentially comprises $CO_2$ heat-transfer medium. In the present example, the organic matter MO has 50% moisture content, this can be freshly cut/collected plant biomass or any other biomass or organic matter that has calorific value. The gaseous treatment stream FT is brought beforehand to its treatment temperature for pyrolysis of the organic matter MO. The treatment temperature is defined by the characteristics of the gasifiable compounds of the organic matter MO and the desired characteristics of the pyrolysis chars.

In stage 100, the organic matter undergoes pyrolysis. Pyrolysis is carried out in the form of several substages, where:

the first is a substage of dehydration of the organic matter, and the last is a stage of carbonization of the organic matter, producing pyrolysis chars from said organic matter MO.

Pyrolysis of the organic matter produces:

on the one hand, a pyrolysis gas stream FP comprising the gaseous treatment stream FT, i.e. essentially $CO_2$, steam $H_2O$ originating from the organic matter and volatile organic compounds VOCs also originating from the organic matter MO, and on the other hand, pyrolysis chars comprising high-temperature carbon components C.

The pyrolysis gas stream FP and the carbon components C are transferred as pyrolysis progresses to a second reactor and will be treated as described below.

The pyrolysis chars are mixed homogeneously with oxides in reduced or deactivated form Me, the mixture is then deposited on a grate in the second reactor to form a layer of redox filtering matter. The carbon components C and the deactivated oxides Me are provided for deoxidation of the steam that passes through this redox layer as described below. The deactivated oxides Me become activated MeO as a result of this deoxidation and are transferred to a deoxidation zone.

In stage 102, the pyrolysis gas stream FP passes through a zone for oxycombustion of a proportion of the VOCs and a zone for oxidation of another proportion of the VOCs present in this pyrolysis gas stream FP. In these zones, the VOCs undergo, at least partly:

on the one hand, oxycombustion by injection of $O_2$ into the pyrolysis gas stream FP; and on the other hand, oxidation by oxides in oxidized or activated form MeO: these activated oxides MeO are the oxides that are mixed with the pyrolysis chars in the redox layer in a deactivated form Me which were first activated (oxidized) as a result of the deoxidation of steam $H_2O$ as described above, then transferred to the zone for oxidation of the VOCs.

The oxycombustion and oxidation of the VOCs is complete and only produces carbon dioxide $CO_2$ and $H_2O$ which will be added to the $CO_2$ used as gaseous treatment stream FT already present in the pyrolysis gas stream FP.

After oxycombustion and oxidation of the VOCs the oxidized pyrolysis gas stream FPO comprises $CO_2$ and steam $H_2O$.

The deoxidation of the activated oxides MeO to the benefit of the VOCs is endothermic and produces deactivated oxides Me which are returned to the layer of redox matter after being mixed homogeneously with new pyrolysis chars produced by pyrolysis of a new feed of organic matter in the first reactor.

Oxycombustion of the VOCs is a particular kind of exothermic oxidation, and produces a large quantity of heat energy. A proportion of this heat energy makes it possible to maintain the oxidation zone at a sufficient temperature for deoxidation of the activated oxides MeO and to bring the steam contained in the oxidized pyrolysis gas stream to the right temperature for the operation of deoxidation thereof by the layer of redox filtering matter formed by the carbon components C and the deactivated oxides Me. Another proportion of this heat energy is transferred as the oxycombustion progresses to the pyrolysis gas stream originating from the first reactor. The pyrolysis gas stream thus acquires an increase in heat capacity promoting its oxycombustion or its oxidation once it arrives in the second reactor. Another proportion ET1 of this heat energy is transferred as the oxycombustion progresses to the layer of redox filtering matter formed by the carbon components C and the deactivated oxides Me. This heat energy ET1 makes it possible to bring the bottom layer of this redox layer up to a high temperature, in the region of 1000° C.

Moreover, complete oxycombustion takes place in the present example upstream of and close to the redox layer. Thus, the transfer of heat energy ET1 to the redox layer takes place naturally and without loss.

In stage 104, the oxidized pyrolysis gas stream FPO passes through the layer of redox filtering matter formed by the carbon components C and the oxides that have been deactivated (or are in a reduced form) Me. The steam $H_2O$ contained in this gaseous stream FPO is then in the required conditions and is subject to the strong redox characteristics of the elements of the layer of filtering matter so that in its turn it is deoxidized by the carbon components C and the deactivated oxides Me of the high-temperature bottom layer of the redox layer, according to the following reactions:

$$C+H_2O \rightarrow CO+H_2$$

$$Me+H_2O \rightarrow MeO_2+H_2$$

This deoxidation, which produces hydrogen $H_2$ and carbon monoxide, is endothermic whereas the subsequent oxidation of the deactivated oxides Me is highly exothermic. The thermal balance is in surplus, the exothermic effect being predetermined by the choice of the proportion of oxide materials Me that will be active in the method according to the invention. This exothermic effect in particular makes it possible to bring and maintain the layer of redox filtering matter, formed by the carbon components C and the deactivated oxides Me (or in a reduced form), as well as the steam (and consequently the gaseous stream in which it is contained), to the optimum temperature for the redox reaction. A proportion of this exothermic effect is also utilized in the configuration of the system according to the invention, for raising the temperature of the pyrolysis gas stream travelling through the double wall separating the two reactors.

Downstream of the redox layer, there is then a synthesis gas stream FS, at high temperature, comprising $CO_2$, hydrogen $H_2$, carbon monoxide CO and residual steam $H_2O$.

In stage 106, the temperature of this synthesis gas stream FS is lowered by recovery of heat energy. The drop in temperature of the synthesis gas stream FS is controlled so as to carry out a reaction called water-shift (or CO-shift) consisting of the deoxidation of steam $H_2O$ by the carbon monoxide components CO, according to the reaction:

$$CO+H_2O \rightarrow CO_2+H_2$$

This reaction is made possible by reducing the temperature of the synthesis gas stream by dissipation of the heat contained in the stream FS. The heat energy ET2 recovered by lowering the temperature of the synthesis gas stream FS can be used, in stage 108, for:

bringing the gaseous treatment stream FT to the treatment temperature of the new feed of organic matter, as will be seen later, and/or producing steam $H_2O_g$. A proportion of this steam can be reinjected into the oxidized pyrolysis gas stream FPO upstream of the layer of redox matter, on the one hand to increase the quantity of hydrogen $H_2$ obtained at the outlet of the redox layer and on the other hand to have sufficient steam $H_2O_g$ downstream of this layer to make the CO shift reaction described above possible.

During stage 106, the molecules of carbon monoxide CO present in the synthesis gas stream FS reduce the molecules of steam $H_2O_g$. This stage 106, i.e. the water-shift reaction, is used to vary the proportion of $H_2$ in the synthesis gas stream and to obtain a specified proportion of $H_2$ in the synthesis gas stream FS.

After the water-shift reaction, the synthesis gas stream no longer contains molecules of CO. The synthesis gas stream therefore comprises hydrogen $H_2$, carbon dioxide $CO_2$ and residual steam $H_2O$.

In stage 110, the residual steam is recovered by condensation. Heat energy ET3 is recovered in this stage and can be utilized by any means known to a person skilled in the art.

The gaseous treatment stream FT, and the carbon dioxide $CO_2$ and hydrogen $H_2$ present in the synthesis gas stream FS are then separated in stage 112, by any systems known to a person skilled in the art.

A proportion of the $CO_2$ recovered is reused as new gaseous treatment stream FT for the pyrolysis of a new feed of organic matter. Prior to this, said gaseous treatment stream FT must be brought to the pyrolysis temperature of about 400/700° C. The temperature of the gaseous treatment stream FT is raised in stage 108 by means of the heat energy ET2 recovered during stage 106, i.e. by lowering the temperature of the synthesis gas stream FS in order to bring it to the temperature of the water-shift reaction described above. Once the gaseous treatment stream FT is at the pyrolysis temperature, it is conveyed to the inlet of the first reactor, in stage 100, for pyrolysis of a new feed of organic matter.

The surplus of $CO_2$ recovered in stage 112 can be condensed and stored.

The hydrogen $H_2$ obtained can also be stored or can be used in power generating devices or systems coupled to the system according to the invention. In this version of the method according to the invention, 100% of the heat energy, a component of the organic matter MO, and 100% of the heat energy, used in the reactions of dehydration and pyrolysis of the organic matter MO, are transformed to available energy in the form of hydrogen $H_2$, after deducting losses and the amounts of energy used in the process.

Figure 2:
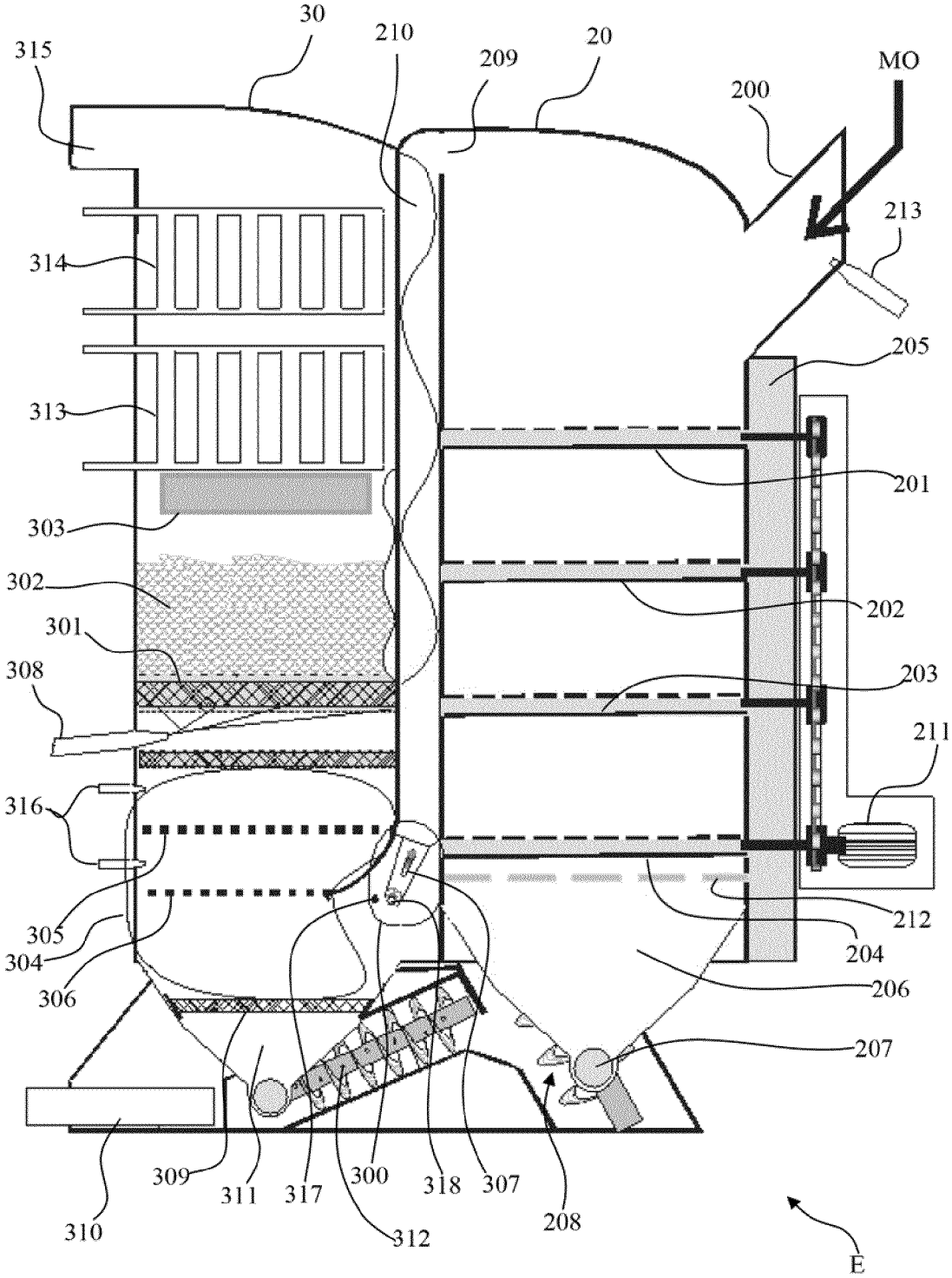
FIG. 2 is a schematic representation according to a sectional view of a system according to the invention.
Figure 3:
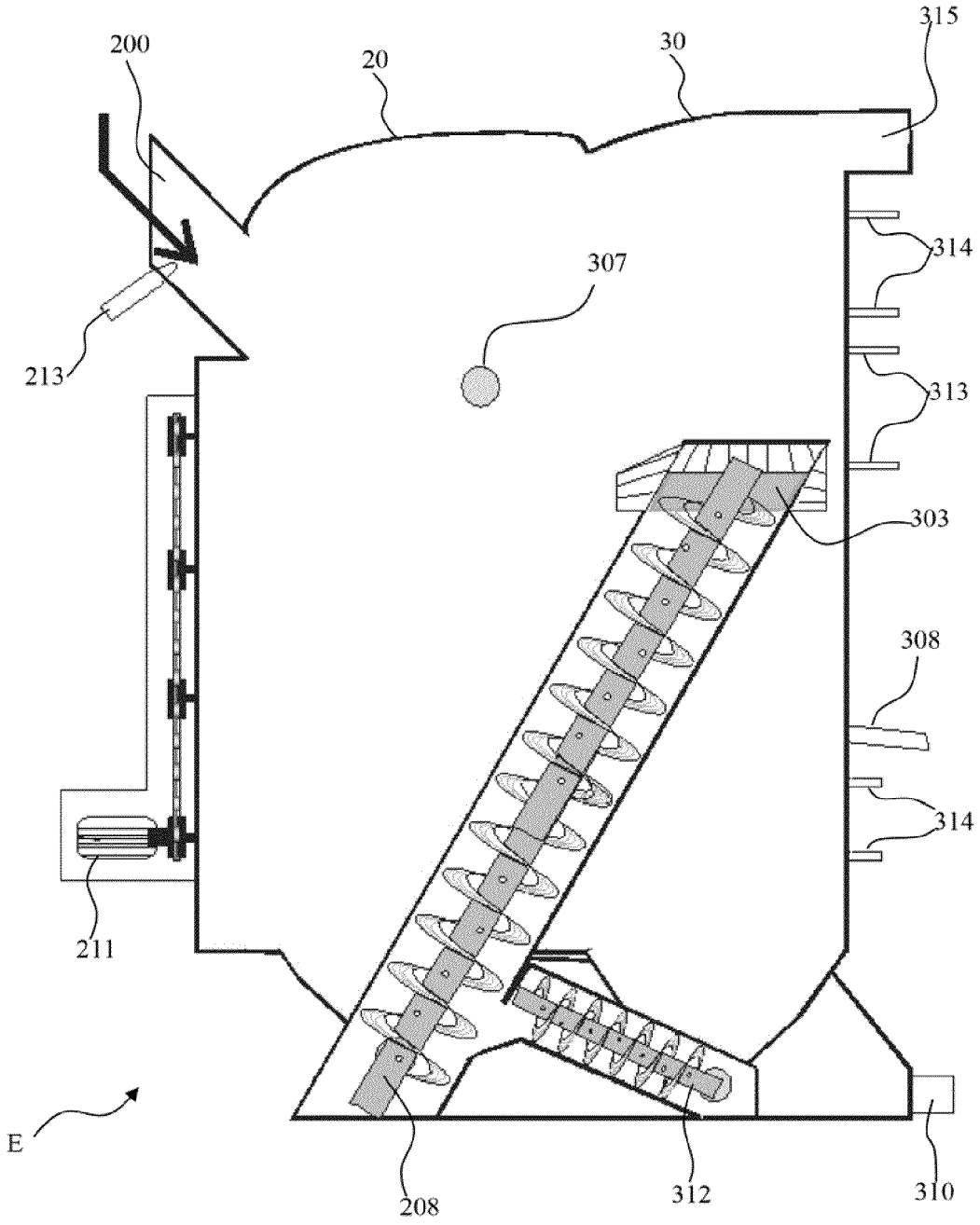
FIG. 3 is a schematic representation according to a rear view of the system in FIG. 1.

FIG. 2 is a schematic representation of a system according to the invention and FIG. 3 shows a rear view of this system. The system shown in FIGS. 2 and 3 comprises, in a single enclosure E, a first reactor 20 and a second reactor 30.

Reactor 20 is the pyrolysis reactor, provided with a gaseous stream of heat-transfer medium for pyrolysis constituted essentially of $CO_2$. Said reactor 20 comprises a chute 200 by which the organic matter MO is fed into said reactor 20.

In the present example, the organic matter MO then passes through four mechanized grates 201-204 defining four levels or zones and provided with holes for distributing a gaseous treatment stream FT within the organic matter arranged on these grates. The gaseous treatment stream is conveyed to the four grates by a double wall 205. The organic matter flows by gravity from one grate to a lower grate and its temperature gradually rises as it passes from one grate to a lower grate.

The organic matter MO is first retained by the first mechanized grate 201. It is dehydrated by the hot gaseous treatment stream originating from the double wall 205 that encloses the pyrolysis reactor 20 on three sides and distributed by the orifices of grate 201. It is also subjected to the reaction of the treatment gases from the lower levels or grates 202-204. Grate 201 as well as grates 202-204 are configured so as to allow the passage of the treatment gases originating from the lower grates and flow of the organic matter thus treated onto the lower grates.

Grate 202 receives the organic matter that flows from grate 201 and grate 203 receives the organic matter that flows from grate 202. These grates 202 and 203 constitute levels where there is progressive pyrolysis of the organic matter. Pyrolysis thus takes place in cascade depending on the number of levels or grates relative to the size of the system as far as the last grate, here grate 204.

Grate 204 constitutes a level where the organic matter is superheated to reduce it to the non-gasifiable portion or portion to be carbonized and to produce pyrolysis chars comprising carbon components. On this grate 204, the volatiles of the organic matter are gasified completely, thus completing the pyrolysis of the organic matter so that only pyrolysis chars are still present.

These pyrolysis chars then pass through grate 204 and are collected in zone 206. Zone 206 has, at its lowest point, a mechanical collecting device 207, for example an Archimedes screw, which takes up the pyrolysis chars and conveys them to a transfer device 208.

The pyrolysis gas stream FP, comprising the steam $H_2O_g$ contained in the raw organic material, the $CO_2$ heat-transfer and treatment medium and the volatile organic compounds VOCs are aspirated by a general extracting mechanism (not shown) through an opening 209 at the top of the pyrolysis reactor 20.

This pyrolysis gas stream FP is at the pyrolysis temperature and is aspirated towards reactors 30 via the double wall 210 alongside and communicating with reactor 30. The aforementioned double wall 210 is shared by the two reactor systems 20 and 30, and makes up the fourth wall of the pyrolysis reactor 20. The space thus configured is provided with devices allowing rapid heat exchange between the wall of reactor 30 and the pyrolysis gas stream originating from the pyrolysis reactor 20. On passing through this space formed by the double wall, the pyrolysis gas stream acquires a temperature favourable to self-ignition before entering reactor 30.

The system further comprises mechanical driving means 211 of the grates 201-204.

The chute 200 for feeding organic matter MO into reactor 20 is sealed with $CO_2$ by $CO_2$ injectors 213.

Reactor 20 further comprises openings 212 provided below grate 204 which distributes the gaseous treatment stream FT.

Moreover, zone 206 for collecting (receiving) pyrolysis chars is shaped for better flow of the materials towards the collecting device 207.

Reactor 30 receives the pyrolysis gas stream FP and after treatment of said stream produces a synthesis gas stream FS comprising hydrogen $H_2$. This reactor 30 is composed, in the present example, of three main zones.

A first zone for deoxidation of steam comprises a grate 301 on which a layer of redox matter 302 is arranged. This layer of redox matter is composed of the pyrolysis chars poured onto grate 301 by the transfer device 208, see FIG. 3, via an opening 303 provided above this grate 301, after being mixed with oxides in a deoxidized form or homogeneously deactivated oxides. The carbon components and the deactivated oxides are provided to carry out the deoxidation of steam $H_2O$ passing through said layer 302. This deoxidation leads to activation of the deactivated oxides, i.e. their conversion to an oxidized form. The activated oxides are then transferred to a second zone of reactor 30 which is the zone for oxidation of the VOCs. The activated oxides participate in the oxidation of the volatile organic compounds VOCs in this zone 304.

The zone for oxidation of volatile organic compounds VOCs 304 is located upstream and below grate 301 and grate 301 is configured to allow the ascending passage of the gaseous stream originating from the zone for oxidation of the VOCs 304 and the flow of the incombustible solids contained in the feed that is constituted on said grate 301.

The pyrolysis gas stream FP comprising volatile organic compounds enters reactor 30 via the opening provided 300 which opens into the bottom part of the zone for oxidation of the VOCs 304. This oxidation zone 304 is arranged so as to provide complete oxidation of the VOCs contained in the pyrolysis gas stream. Grates 305 and 306 are suitably arranged so as to slow the flow by gravity of the activated oxides and allow the complete oxidation of the VOCs on contact with these activated oxides in said zone 304. This stoichiometric oxidation can advantageously be prepared by oxycombustion of the VOCs by oxygen injected into the opening arrangement 300 by an oxygen injector 307: opening 300 can also be called the zone for oxycombustion of the VOCs and is located upstream of the zone for oxidation of the VOCs by the activated oxides 304.

Thus, the zone for oxidation, in the broad sense, of the VOCs corresponds to:

zone 304 for oxidation of the VOCs by the activated oxides, and the zone for oxycombustion (or opening) 300 of the VOCs by injection of $O_2$.

The combined pyrolysis gases are subjected to the action of the oxygen and/or activated oxides as they pass through these zones 300 and 304 and grates 305, 306 in order to carry out stoichiometric oxidation of the VOCs before they pass through the layer of redox matter 302.

If the temperature of the combined oxidized gases is not adequate, on leaving zone 304, for immediate reaction on contact with the layer of redox matter, it will be supplemented by the oxycombustion of a proportion of the carbons making up the bottom layer of redox matter by injection of oxygen by an oxygen injector 308 provided at the level of grate 301 supporting the layer of redox matter.

Combustion of these VOCs takes place without flame when using oxides and with flame when using oxygen for supporting combustion. This combustion is fully controlled by temperature sensors 316 and a system for ignition 317 and flame control 318. When using oxides, the reaction is endothermic, and control is provided by partial oxycombustion of the VOCs under zone 304.

The configuration of reactor 30 is defined in its lower portion by a device 309 for separating the solids originating from the redox layer and passing through the zone for oxidation of the VOCs 304: minerals and deactivated oxides Me. Said separating device 309 can for example be a vibrating belt. The minerals are discharged from the surface of the separating device 309 to a container where they are taken up by a sealed discharging device 310.

The deactivated oxides flow by gravity towards a zone 311 for collecting the oxides deactivated by the VOCs. This zone is shaped for better collection of the deactivated oxides and comprises a collecting device. The deactivated oxides are taken up by a transfer system 312 and are directed towards transfer system 208, where they will be mixed with the pyrolysis chars to produce an intimate mixture and poured onto grate 301 via opening 303.

The oxidized pyrolysis gas stream passing through the layer of redox matter 302 now only contains steam $H_2O_g$ and $CO_2$. The steam $H_2O_g$ contained in the pyrolysis gas stream will exchange its atomic oxygen O with the carbons and inactive oxides of layer 302 to form $H_2$ and CO and active oxides MeO. The reaction is exothermic if layer 302 contains oxides whereas it is endothermic if the layer only contains pyrolysis chars. To control the temperature at the level of grate 301 and in layer 302, the oxygen injector 308 supplies additional oxygen under grate 301 in order to provide a thermal base for compensation.

Thus, the oxides capture the heat energy of the VOCs by oxidizing them and transport it within the redox layer where it is transferred as capacitive energy for the reaction of deoxidation of $H_2O$ by the pyrolysis chars. The reaction between oxides and VOCs makes it possible to transfer the total energy of the VOCs to the oxides Me, which allows their substitution as a means of deoxidation of $H_2O$ by Me, which an ordinary thermal reaction of the VOCs would not be able to do, even under oxygen for supporting combustion. This secondary reaction by the oxides allows the largest transfer of the energy contained in the organic matter to the production of synthesis hydrogen, it can be recycled continuously.

Downstream of layer 302, there is a synthesis gas stream FS comprising $H_2$, CO, $CO_2$ and $H_2O_g$ (superheated steam). Moreover, the pyrolysis chars are reduced to the minerals contained by the original organic matter and the oxides Me are activated MeO, they are at the optimum temperature promoting reaction with the VOCs in the zone for oxidation of the VOCs 304. To control the important exothermic reaction due to activation of the oxides, it is necessary to control the proportion of oxides in layer 302 and dissipate the excess heat to devices requiring a heat input. For this, heat exchangers are provided, the first being the shared double wall 210 in which all of the pyrolysis gases circulate. Two other exchangers 313 and 314 are located at the top of reactor 30 which makes up the third main zone of said reactor 30. On passing through these exchangers 313 and 314, the synthesis gas stream gives up its heat energy, thus allowing and facilitating the CO shift reaction on $H_2O$ to $H_2$ and $CO_2$, if necessary. The synthesis gas stream leaves reactor 30 via a discharge hole 315. The synthesis gas stream leaving from opening 315 is composed essentially of $H_2$, $CO_2$ and $H_2O$, which are easily separated. This synthesis gas stream is extracted from reactor 30 via a general extraction system (not shown). Once separated, the useful portion of $CO_2$ can be fed back into exchanger 313, where it will take its heat capacity of heat-transfer gas, to be recycled and used as gaseous treatment stream in reactor 20. Moreover, liquid water $H_2O_L$ can be fed into exchanger 314 to be vaporized to supply steam $H_2O_g$ on the one hand to control the exothermic effect of the reaction in the layer of redox filtering matter 302 and the CO-shift thermal reaction, and on the other hand to be used as steam for deoxidation.

The system further comprises a distributor/diverter (not shown) of the pyrolysis chars, which can be mixed with deactivated oxides. These materials are thus distributed and mixed homogeneously and deposited on grate 301 as a redox feed defined according to the system dimensions.

Figure 4:
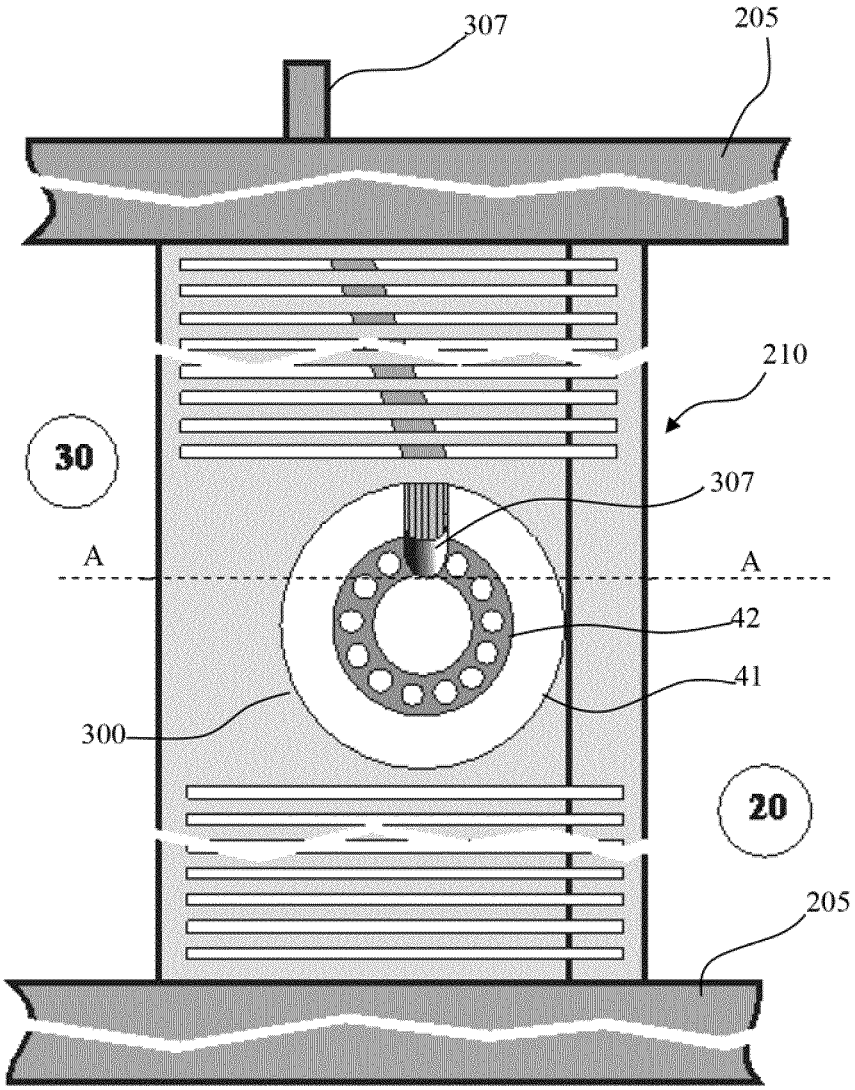
FIG. 4 is a schematic representation according to a top view of an oxycombustion zone in the system in FIG. 2.
Figure 5:
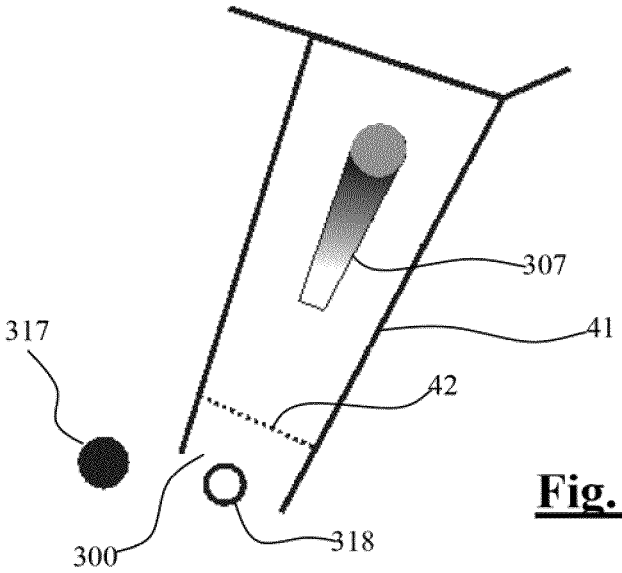
FIG. 5 is a representation according to a sectional view of the oxycombustion zone in FIG. 4.

FIG. 4 is a schematic representation of a top view of the double wall 210 and FIG. 5 shows this wall according to a sectional view along AA. As described above, at the bottom of this double wall there is an opening 300, at the level of which oxycombustion of the VOCs is carried out by injection of $O_2$ by an injector 307. In fact, as shown in FIG. 4, at the bottom of the double wall there is a bay 41, into which the oxygen injector 307 opens. This bay comprises a grate 42 controlling the flow of the pyrolysis gas stream FP and improving the combustion of the VOCs.

Figure 6:
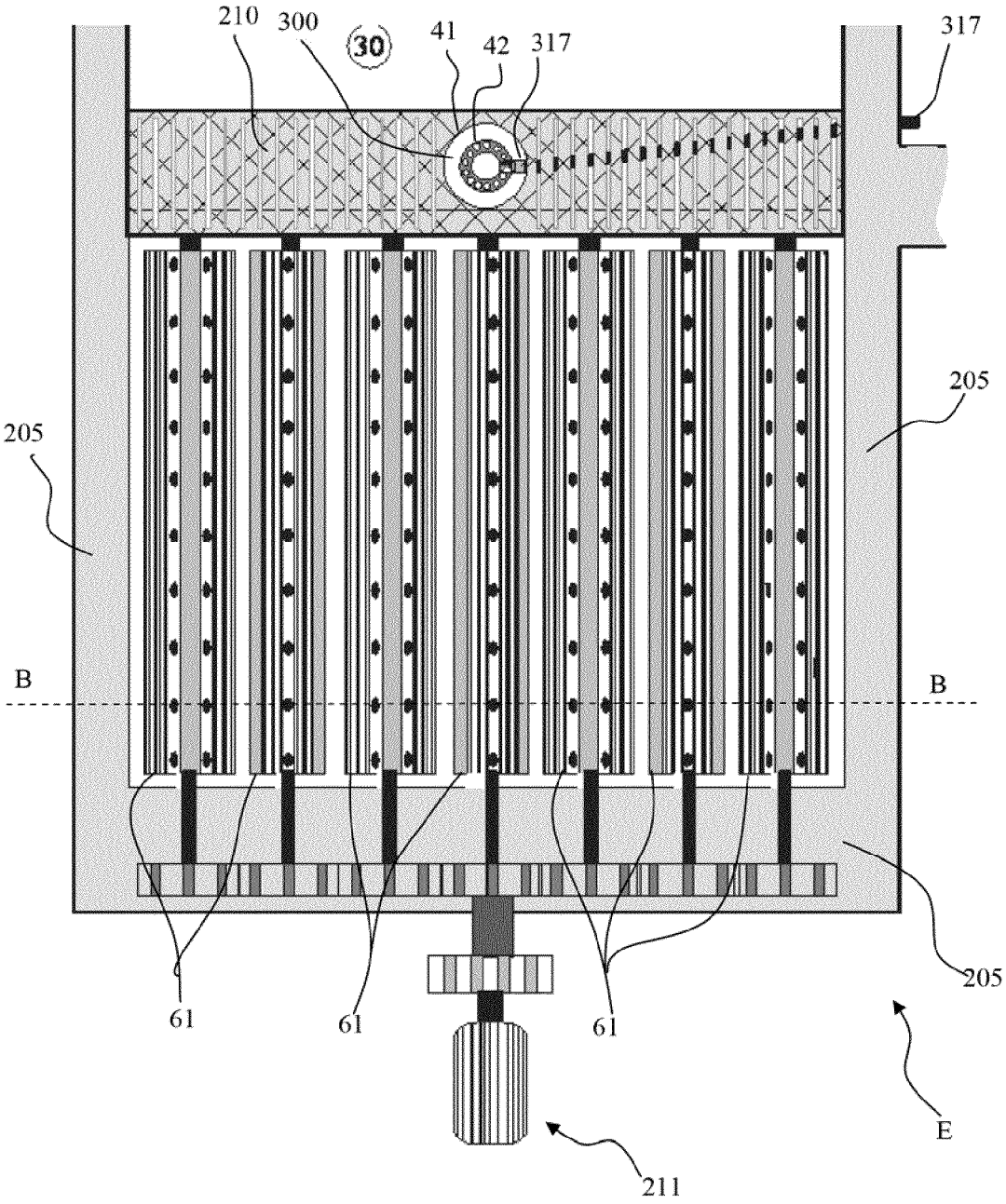
FIG. 6 is a schematic representation according to a top view of a grate used in the system in FIG. 2.

FIG. 6 is a schematic representation of a top view of one of the grates 201-204. The grate shown in FIG. 6 is arranged so as to receive the organic matter, allow the ascending passage of the gaseous stream in reactor 20 and the flow by gravity of the incombustible solids contained in the organic matter. This grate provided for receiving the organic matter is composed of several bars 61.

Figure 7:
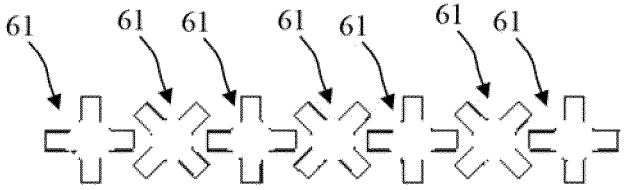
FIG. 7 is a schematic representation according to a sectional view of the grate in FIG. 6.
Figure 8:
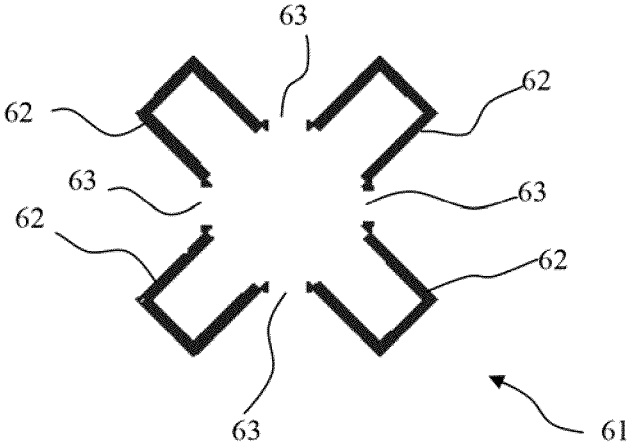
FIG. 8 is a schematic representation according to a sectional view of a bar of the grate in FIG. 6.

FIG. 7 is a sectional view of the grate in FIG. 6 along BB and FIG. 8 is a sectional view of a bar 61. Each of the bars 61 has teeth 62, in contact with the elements of the adjacent bars, and entraining one another during rotation. In fact, during rotation the teeth 62 of one bar 61 engage with the teeth of an adjacent bar and carry it along in rotation. During their rotation, the teeth 62 of the bars also entrain the organic matter arranged on the grate.

Moreover, each of the bars 61 has a hollow cylindrical body conveying the gaseous treatment stream. The gaseous treatment stream is injected into the core of the organic matter arranged on the grate through openings 63 provided in the cylindrical body of each of the bars 61.

The invention is not of course limited to the example of application described above.

The invention claimed is:

1. A method for production of hydrogen from organic matter, said method comprising the following stages:

pyrolysis of a feed of organic matter by passing a gaseous treatment stream comprising carbon dioxide through said organic matter, said pyrolysis producing, on the one hand, a pyrolysis gas stream comprising the gaseous treatment stream, steam and volatile organic compounds originating from said organic matter, and on the other hand pyrolysis chars comprising carbon components;

oxycombustion of at least a proportion of said volatile organic compounds present in said pyrolysis gas stream, by injection of oxygen, upstream of a layer of redox filtering matter comprising high-temperature carbon components; and after said oxycombustion, passing said oxidized pyrolysis gas stream through said redox layer, said passage producing a synthesis gas stream comprising hydrogen obtained by deoxidation of steam by the high-temperature carbon components.

2. The method according to claim 1, characterized in that the redox layer further comprises oxides in a reduced form, said oxides achieving a deoxidation of a proportion of the steam, said deoxidation producing hydrogen components, and after said deoxidation said oxides are in an oxidized form.

3. The method according to claim 2, characterized in that at least a proportion of the oxides in oxidized form obtained as a result of the deoxidation of steam in the redox layer, is used for oxidation of a proportion of the volatile organic compounds upstream of the redox layer, after said oxidation said oxides again being in their reduced form, at least a proportion of said oxides in their reduced form being reused in the redox layer for deoxidation of steam again.

4. The method according to claim 1, characterized in that at the outlet of the redox layer, the synthesis gas stream further comprises carbon monoxide and steam, said method comprising a lowering/control of the temperature of the synthesis gas stream downstream of said redox layer, said lowering/control of temperature bringing about a redox reaction, called water-shift, between said carbon monoxide and said steam, said redox reaction producing $H_2$ and $CO_2$.

5. The method according to claim 4, characterized in that the synthesis gas stream further comprises residual steam after the water-shift reaction, said method further comprising separation of said residual steam by condensation of said steam.

6. The method according to claim 4, characterized in that it further comprises a stage of separation of the dihydrogen present in the synthesis gas stream.

7. The method according to claim 6, characterized in that after separation of the dihydrogen, the synthesis gas stream comprises carbon dioxide, at least a proportion of said carbon dioxide being reused as gaseous treatment stream for the pyrolysis of a new feed of organic matter.

8. The method according to claim 4, characterized in that the lowering of the temperature of the synthesis gas stream downstream of the redox layer comprises a transfer of heat energy from said synthesis gas stream to at least a proportion of the gaseous treatment stream, thus bringing said gaseous treatment stream to a temperature for pyrolysis of a feed of organic matter.

9. The method according to claim 2, characterized in that the pyrolysis chars and the oxides in a reduced form are mixed homogeneously and then arranged on the redox layer.

* * * * *